US005201412A

United States Patent [19]

Schuster et al.

[11] Patent Number: 5,201,412

[45] Date of Patent: Apr. 13, 1993

[54] CLIP-TYPE ARTICLE CARRIER

[75] Inventors: Richard L. Schuster, Monroe; Leonard M. Cooper, West Monroe, both of La.

[73] Assignee: Riverwood Natural Resources Corporation, Denver, Colo.

[21] Appl. No.: 876,595

[22] Filed: Apr. 30, 1992

[51] Int. Cl.[5] ..... B65D 71/00

[52] U.S. Cl. ..... 206/153; 206/158; 294/87.2

[58] Field of Search ..... 206/139, 145, 146–161; 294/87.2

[56] References Cited

U.S. PATENT DOCUMENTS

| | | | |
|---|---|---|---|
| 2,737,326 | 3/1956 | Toensmeier | 294/87.2 |
| 3,281,180 | 10/1966 | Sperry | 206/153 |
| 3,414,313 | 12/1968 | Schwartz | 206/157 |
| 3,653,503 | 4/1972 | Arneson | 294/87.2 |
| 3,661,417 | 5/1972 | Inman | 294/87.2 |
| 3,767,041 | 10/1973 | Graser | 294/87.2 |
| 4,192,540 | 3/1980 | Oliff | 206/161 |
| 4,449,744 | 5/1984 | Vossen | 294/87.2 |
| 5,103,971 | 4/1992 | Schuster | 206/153 |

FOREIGN PATENT DOCUMENTS

| | | | |
|---|---|---|---|
| 1203926 | 10/1965 | Fed. Rep. of Germany | 294/87.2 |
| 1028498 | 5/1966 | United Kingdom | 294/87.2 |
| 1604840 | 12/1981 | United Kingdom | 206/145 |

*Primary Examiner*—Jimmy G. Foster

[57] ABSTRACT

A paperboard clip-type carrier especially suited for carrying beverage cans. The top panel comprises overlapped inner and outer top panel flaps which provide double thickness in the handle area. Support edges in reinforcement sections connected to the bottom panel and the side panels engage the underside of the can chimes to support them, and stress relief score lines are provided to distribute stresses from the support edges through the reinforcement sections. The side panel has cutouts through which the can chimes can protrude, allowing the side panels to be positioned tightly against the cans to increase the strength of the carrier.

15 Claims, 3 Drawing Sheets

CLIP-TYPE ARTICLE CARRIER

FIELD OF THE INVENTION

This invention relates to article carriers. More particularly, it relates to article carriers that grip the upper portions of articles so as to suspend them from the carrier.

BACKGROUND OF THE INVENTION

Carriers that grip the upper portions of articles to enable the articles to be lifted and carried are well known, particularly in connection with beverage cans. For example, plastic carriers which contain openings that fit over the tops of beverage cans so as to grip the cans in the reduced neck area just below the can chimes are often employed. Although economical to produce, such clip-type carriers have certain drawbacks. The thin plastic material at the finger holes can be painful to the user's fingers when the package is carried for any length of time. Further, the thin material required to enable the carrier to be forced over the tops of the cans limits the weight of the package. For these reasons plastic carriers are normally not used to carry more than six 12-ounce cans in a package. In addition, the use of such carriers provides no space for printed advertising material or other indicia. Further, discarded plastic carriers have been seen as creating environmental problems.

Paperboard carriers have been designed for carrying beverage containers in similar fashion, that is, by gripping the top portions of containers so that the suspended containers beneath that point are unenclosed. One such design for carrying beverage cans consists of a bottom panel containing apertures through which the tops of the cans extend. The cans are held in place by support edges which engage the underside of the can chimes. Short side panels, which cover the edges of the cans, connect the bottom panel to top panel flaps, and the top panel flaps are glued to the bottom panel. Aligned finger openings in the top and bottom panels enable the carrier to be lifted and carried. An example of this type of carrier is disclosed in U.S. Pat. No. 3,653,503. Although the disclosed carrier provides certain advantages, such as being more comfortable to carry than plastic carriers, providing substantially unbroken areas in the top panel for receiving printed indicia and being more environmentally acceptable, it falls short of providing the desired level of strength.

It would therefore be desirable to provide a carrier which retains the benefits of known paperboard clip-type carriers, but in addition provides increased strength.

BRIEF SUMMARY OF THE INVENTION

The invention provides a carrier for supporting a plurality of articles each of which has an upper surface and an outwardly projecting lip adjacent the upper surface, such as the chimes of a beverage can. The carrier comprises a top panel, side panels connected to the top panel by first fold lines and a bottom panel connected to side reinforcing sections by second fold lines interrupted by slits, the side reinforcing sections being connected to the side panels by third fold lines. The slits are spaced from each other and from the second fold lines, and are dimensioned with respect to an article to be supported so as to enable the projecting lip of the article to extend through the spaced slits. Each slit forms an adjacent support edge in the adjacent side reinforcing section adapted to contact the underside of the lip of the article to thereby support the article. The top panel is adhered to the bottom panel, and cutouts are provided in the side panels for receiving the lip of the article. This causes the angle between a side reinforcing section and an adjacent side panel to be a relatively small acute angle and the angle between the top panel and a side panel to be a relatively large obtuse angle. The side panels thus are closely spaced from the adjacent side reinforcing section to add strength to the carrier.

The carrier is formed from a single substantially rectangular sheet of a flexible material, such as paperboard. The top panel preferably comprises an inner top panel flap connected to one of the side panels and an outer top panel flap connected to the opposite side panel, the outer top panel flap overlying the inner top panel flap and being adhered thereto. Preferably, this is achieved by adhering the inner top panel flap to the bottom panel by adhesive and also adhering the outer top panel flap to the inner top panel flap by adhesive.

Stress relief score lines are preferably provided in the side reinforcing sections extending from the slits to the third fold lines in order to more uniformly distribute lifting and carrying stresses to the reinforcing sections. Where the carrier is intended to support two rows of articles, the bottom panel includes interior reinforcing sections connected to the bottom panel by fourth fold lines interrupted by additional slits similar to the slits associated with the second fold line. Adjacent interior reinforcing sections are connected to each other by fifth fold lines so as to provide support edges for a plurality of rows of articles.

By overlapping the top panel flaps a double thickness of material in the handle area of the carrier is provided, making the carrier significantly stronger than previous clip-type carriers. The carrier is made even stronger by the arrangement whereby the side panels are so closely spaced to the adjacent reinforcing sections as to approach being in face to face contact.

The features of the invention which enable it to provide the desired results are bought out in more detail in the description of the preferred embodiment, wherein the above and other aspects of the invention, as well as other benefits, will readily become apparent.

DETAILED DESCRIPTION OF THE PREFERRED EMBODIMENT

Figure 1:
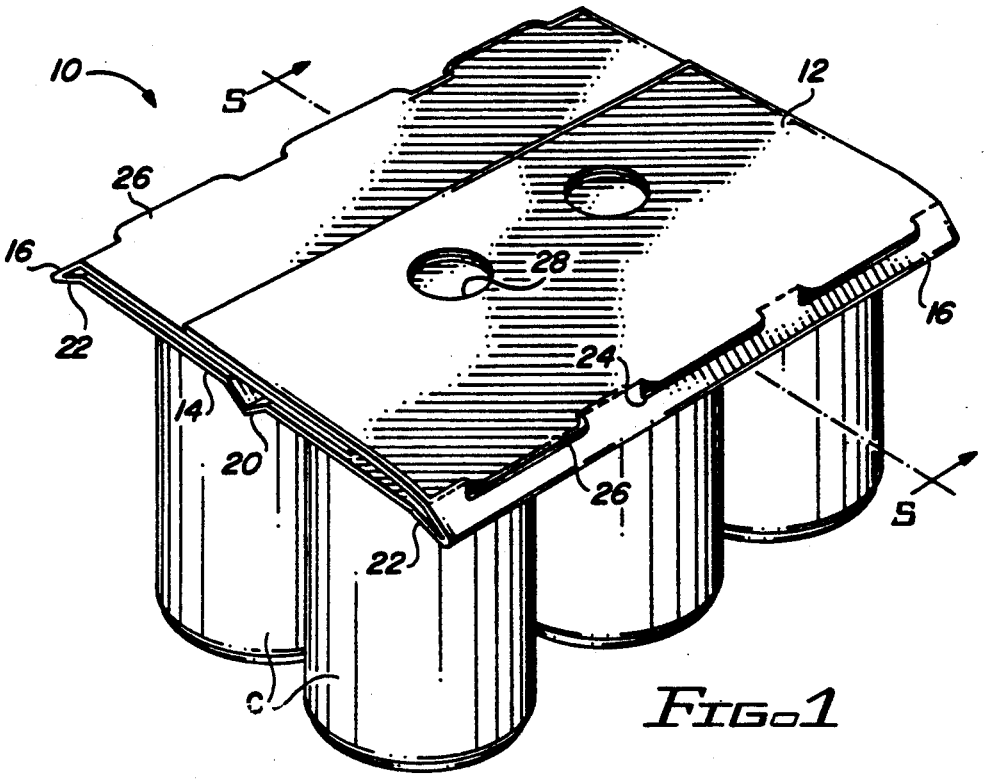
FIG. 1 is a pictorial view of a package of beverage cans the top portions of which are held by the carrier of the invention.

Referring to FIG. 1, a carrier 10 is comprised of a top panel assembly 12 connected to bottom panel 14 by short side panels 16. The upper portions of cans C extend through openings in the bottom panel 14 and are held in place by support tabs, neither the openings nor the support tabs being visible in this view. The top panel is not as wide as the bottom panel, resulting in the side panels 16 being inwardly sloped. A reinforcing rib 20 is provided in the bottom panel between rows of the cans, and side reinforcing strips 22 are provided at the side edges of the carrier adjacent the side panels 16. The side panels contain cutouts 24 which are aligned with the rim or chime of adjacent cans and are located immediately beneath tabs 26 which extend outwardly from the top panel assembly 12. Finger holes 28 are provided in the top panel to facilitate lifting the carrier. Although the carrier illustrated is adapted to carry six cans, it will be understood that the invention is not limited by the number of articles supported by the carrier.

Figure 2:
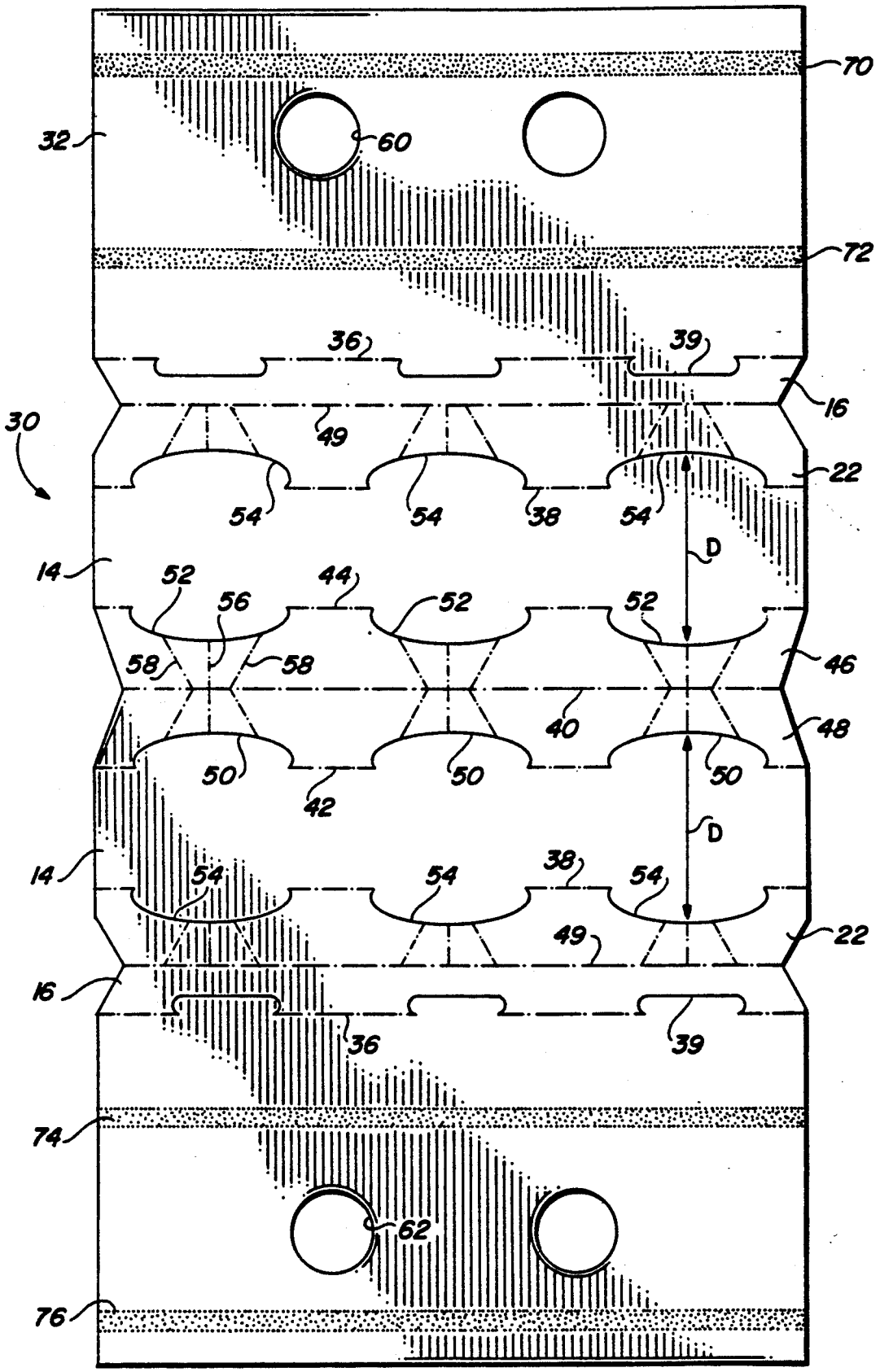
FIG. 2 is a plan view of a blank for forming the carrier of FIG. 1.

Referring to FIG. 2, wherein like reference numerals to those used in FIG. 1 denote like structure, the carrier is formed from a generally rectangular blank 30, which includes an inner top panel flap 32 at one end of the blank and an outer top panel flap 34 at the other. The top panel flaps are connected to side panel sections 16 by fold lines 36, and the side panel sections are in turn connected to side reinforcing sections 22. A centrally located bottom panel section which includes identical bottom panel sections 14 is connected at opposite ends to the side reinforcing sections 22 by fold lines 38 and is divided into equal portions by fold line 40. On either side of the fold line 40 are spaced parallel fold lines 42 and 44 which together with the fold line 40 create central reinforcing rib sections 46 and 48. The side panel sections 16 are connected to the side reinforcing sections 22 by fold lines 49.

The fold lines 42 and 44 are each interrupted by three curved slits 50 and 52, respectively, which may be referred to as C-shaped slits, the convex sides of which face the intermediate fold line 40. Each fold line 38 is also interrupted by three C-shaped slits 54 similar to the slits 50 and 52 and located so that the concave sides of the slits 50 and 52 face the concave sides of opposed slits 54. Preferably, the C-shaped slits terminate in opposing arcuate ends to resist the tendency to tear at this stress point. In addition, the fold lines 36 are interrupted by three slits 39, each of which is generally similar to the C-shaped slits, but are shorter and straighter than the C-shaped slits. The slits 39 are located opposite the slits 54.

The fold lines 40, 49 and 36 may be in the form of skip-cut lines to facilitate folding of the blank along these lines during formation of the carrier. It is preferred, however, that the fold lines 38, 42 and 44 be in the form of score lines to strengthen the bottom panel of the carrier and prevent tearing. In addition, a set of three score lines is provided at each C-shaped slit in order to better distribute lifting and carrying stresses from the areas adjacent the cans in the package to the folds of the carrier. Thus, score lines 56 extend from substantially the midpoint of each C-shaped slit to the nearest fold line 40 or 49 at substantially right angles, and score lines 58 extend from points on the slit on either side of the score line 56 at an acute angle to the nearest fold line. Although the points at which the score lines contact the C-shaped slits and the fold lines may vary according to need, it is preferred that the score lines be arranged so that the angled score lines 58 and their associated C-shaped slit form a generally truncated triangle with the nearest fold line in order to achieve the best distribution of stress.

The inner and outer top panel flaps 32 and 34 are also provided with finger holes 60 and 62, respectively, with the holes 60 preferably being slightly larger than the holes 62 to ensure that the holes 62 are aligned with the holes 60 when the outer flap 34 is moved into final overlapping position with respect to the inner flap 32.

Figure 3:
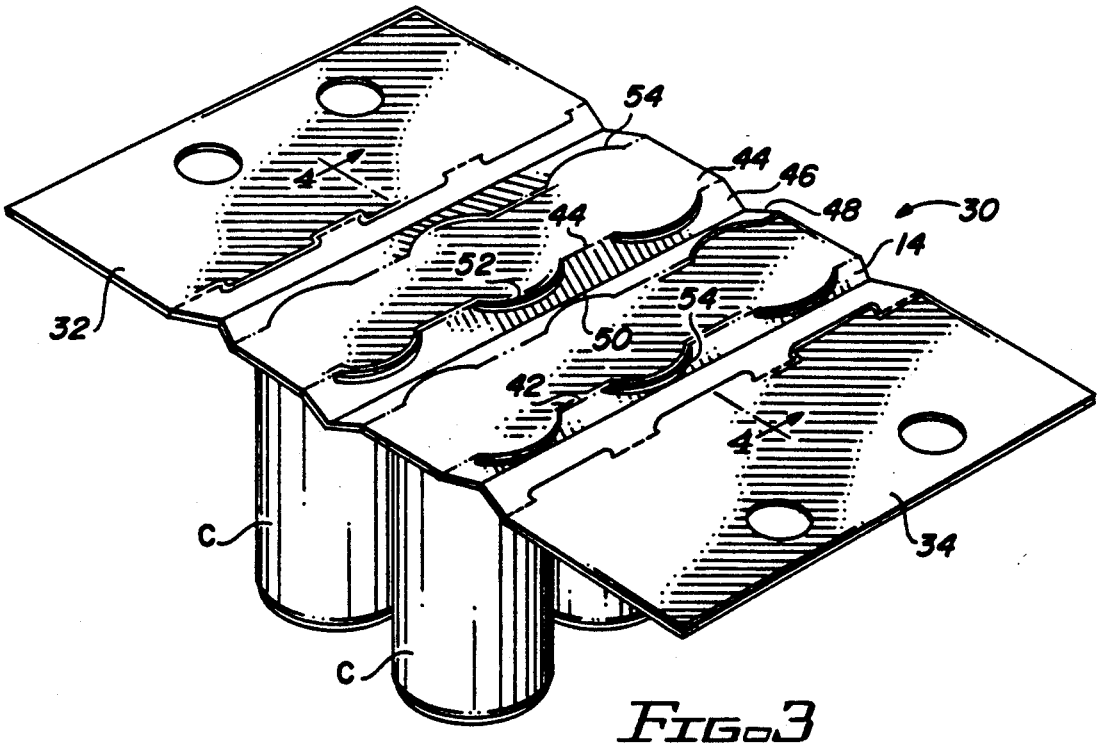
FIG. 3 is a pictorial view of the carrier of FIG. 1 shown with the top flaps open prior to being folded in to form the top panel.
Figure 4:
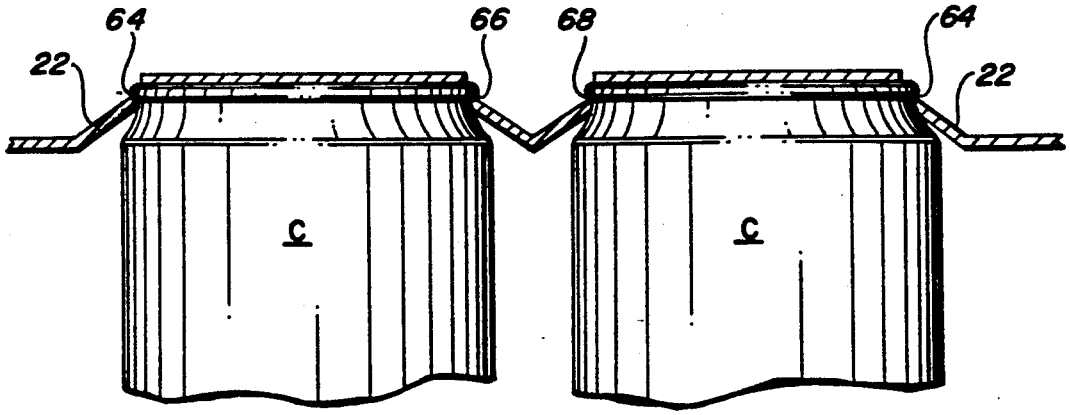
FIG. 4 is an enlarged partial sectional view taken on line 4—4 of FIG. 3.

To form the carrier 10, the blank 30 is positioned on top of a group of six adjacent cans C which have been arranged in two rows of three each so that the C-shaped slits are substantially aligned with opposite portions of the rims of the cans, which is the arrangement illustrated in FIG. 3. Note that the two rows of cans are spaced apart a short distance in order to be properly aligned with the blank. Relative movement between the bottom panel section 14 and the cans is caused by applying downward pressure to the bottom panel section. The distance D, shown in FIG. 2, between the midpoints of opposite C-shaped slits 50 and 54 and between opposite C-shaped slits 52 and 54 is substantially equal to the diameter of the reduced diameter portion of a can just below the can chime. When relative movement of the cans and bottom panel section occurs the can chimes are forced through the slits due to the resiliency of the paperboard until the locking edges in the reinforcing sections formed by the C-shaped slits snap back into the reduced diameter portion of the cans. This arrangement is illustrated in FIG. 4, wherein the locking edges 64 of the side reinforcing sections 22 and the locking edges 66 and 68 of the central reinforcing rib sections 46 and 48 are shown in engagement with the bottom or underside of the can chimes. Referring to FIGS. 1 and 3, the top panel flaps are next folded up about the fold lines 49 and the outer top panel flap 34 is brought into overlapping relationship with the inner top panel flap 32. If the top flaps were merely folded with no further movement of the rows of cans relative to each other, the rows of cans would be maintained in the spaced positions illustrated in FIG. 4. Instead, the rows of cans are moved toward each other so that adjacent cans in the adjacent rows are in abutting relationship. With the cans in this position the top panel flaps are moved to their final positions in which the finger holes are aligned.

Figure 5:
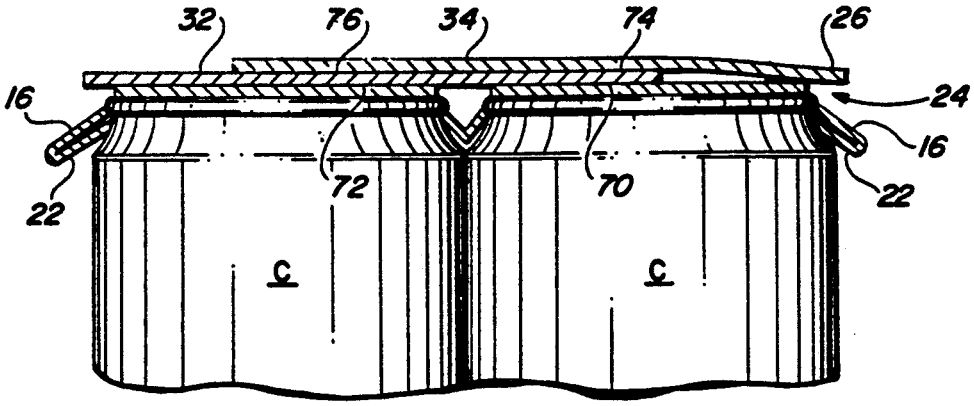
FIG. 5 is an enlarged partial sectional view taken on line 5—5 of FIG. 1.

To hold the top panel flaps in place they are adhered by means of the glue lines 70, 72, 74 and 76. The glue line 70 is located between the finger holes 60 and the side edge of the inner top panel flap 32 and the glue line 72 is located between the finger holes 60 and the fold line 36 so that upon the inner top panel flap being folded over into final position, the glue 70 contacts the portion of the bottom panel 22 overlying the far row of cans while the glue 72 contacts the portion of the bottom panel overlying the near row of cans. In like manner, when the outer top panel flap 34 is folded over onto the inner top panel flap the glue 76 contacts the inner top panel flap in an area overlying the far row of cans while the glue 74 contacts the inner top panel flap in an area overlying the near row of cans. This is illustrated in FIG. 5, wherein it can be seen that with minimal glue application the top panel flaps of the carrier overlap each other for a majority of their width to form an extremely strong carrier capable of carrying heavy loads. The presence of the stress relief score lines extending from the locking edges to the nearest longitudinal fold line further uniformly distributes stresses to areas better capable of withstanding them, thereby further strengthening the carrier.

The carrier blank may be moved relative to the cans and the top panel flaps tightened into their final position by any suitable means. Although details of apparatus for carrying out these functions are not disclosed herein, the design of such equipment is well within the scope of those skilled in the packaging art. For example, the method of assembly disclosed in U.S. Pat. No. 3,653,503 could be employed.

Figure 6:
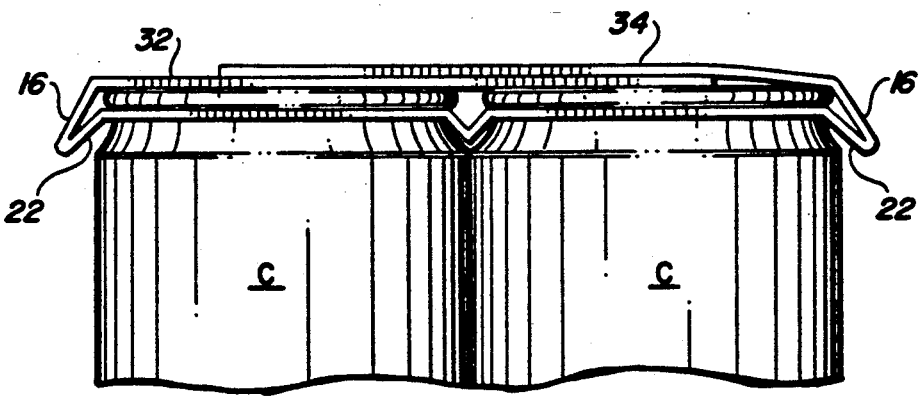
FIG. 6 is an enlarged partial end view of the carrier package of FIG. 1.

Referring now to FIGS. 1, 5 and 6, when the top panel flaps are tightened to their full overlapping position with the cans of one row abutting the cans in the next row, the angle between the sections 46 and 48 of the center reinforcement rib 20 is lessened and the fold 40 moves in a downward direction. The dimensions of the rib sections are selected so that in the final position of the carrier the rib terminates at about the juncture of the adjacent cans, with the sections 46 and 48 generally following the contours of the cans between their cylindrical portions and their chimes. This adds strength to the carrier and serves to hold the cans in place.

It can be seen that the side walls 16 of the carrier are sloped in toward the top panel in the final carrier configuration instead of being substantially straight as in prior art clip-type carriers. Not only are the side panels sloped, they are preferably sloped to the maximum extent possible. Thus the side walls are not limited in their angled configuration by contact with the chimes of the cans since the presence of the cutouts 24 in the side panels formed by the slits 39 allows the chimes in this location to protrude through the cutouts beyond the boundary of the side walls. The tabs 26 formed by the slits 39 extend over the cutouts to protect the can chimes from damage. By reducing the distance between the side panels 16 and the adjacent side reinforcing strip 16 the strength of the side wall is increased. As shown in FIGS. 5 and 6, the side panels actually approach face to face contact with the adjacent reinforcement strips, thereby maximizing the benefit of this arrangement.

It will now be clear that the invention improves the strength of clip-type paperboard carriers without increasing their cost. Obviously, although the invention has been described in connection with a carrier designed to hold six beverage cans, the principles of the invention may be incorporated in carriers designed to hold fewer or more cans. Moreover, the invention is not limited to use with cans, but may be extended to other types of articles having a rim or other projection capable of being gripped by locking or supporting edges of the carrier. Because the invention is not necessarily limited to all the specific details described in connection with the preferred embodiment, except as they may be within the scope of the appended claims, changes to certain features of the preferred embodiment which do not alter the overall basic function and concept of the invention are contemplated.

What is claimed is:

1. A carrier for supporting a plurality of articles each of which has an upper surface and an outwardly projecting lip adjacent the upper surface, comprising:

a top panel assembly;

side panels connected to the top panel by first fold lines;

a bottom panel connected to the side reinforcing sections by second fold lines interrupted by slits;

the side reinforcing sections being connected to the side panels by third fold liens, said side reinforcing sections including stress relief score lines extending from the slits to the third fold lines;

the slits interrupting the second fold liens being spaced from each other and from the second fold lines, the slits being dimensioned with respect to an article to be supported by the carrier so as to enable the projecting lip of the article to extend through the spaced slits;

each slit forming n adjacent support edge in the adjacent side reinforcing section, the support edges being adapted to contact the underside of the lip of the article to thereby support the article;

means for adhering the top panel to the bottom panel; and cutouts in the side panels for receiving the lip of the article;

the angle between a side reinforcing section and the side panel being a relatively small acute angle and the angle between the top panel and the side panel being a relatively large obtuse angle.

2. The carrier of claim 1, wherein the top panel assembly is comprised of an inner top panel flap connected to one of the side panels and an outer top panel flap connected to the opposite side panel, the outer top panel flap overlying the inner top panel flap and being adhered thereto.

3. The carrier of claim 2, wherein the means for adhering the top panel to the bottom panel comprises adhesive means for adhering the inner top panel flap to the bottom panel and adhesive means for adhering the outer top panel flap to the inner top panel flap.

4. The carrier of claim 2, wherein the inner and outer top panel flaps contain aligned finger holes to facilitate lifting the carrier.

5. The carrier of claim 1, wherein the bottom panel includes interior reinforcing sections connected to the bottom panel by fourth fold lines interrupted by additional slits similar to the slits associated with the second fold line, adjacent interior reinforcing sections being connected to each other by fifth fold liens so as to provide support edges for a plurality of rows of articles.

6. The carrier of claim 5, including stress relief score liens int he interior reinforcing sections extending from the additional slits to the fifth fold line.

7. A clip-type carrier, comprising:

a top panel assembly;

side panels connected to the top panel by first fold lines;

a bottom panel connected to side reinforcing sections by second fold lines interrupted by slits;

the side reinforcing sections being connected to the side panels by third fold lines;

the slits interrupting the second fold lines being spaced from each other and from the second fold lines and forming an adjacent support edge in the adjacent side reinforcing section, the support edges contacting the underside of the chimes of beverage cans to thereby support the cans;

stress relief score lines in the side reinforcing sections extending from the slits to the third fold lines;

means for adhering the top panel to the bottom panel; and cutouts int eh side panels for receiving the chimes of the cans;

the angle between a side reinforcing section and the side panel being a relatively small acute angle and the angle between the top panel and the side panel being a relatively large obtuse angle.

8. The clip-type carrier of claim 7, wherein the top panel assembly is comprised of an inner top panel flap connected to one of the side panels and an outer top panel flap connected to the opposite side panel, the inner top panel flap being adhesively adhered to the bottom panel and the outer top panel flap being adhesively adhered to the inner top panel flap.

9. The clip-type carrier of claim 7, wherein the bottom panel includes interior reinforcing sections connected to the bottom panel by fourth fold lines interrupted by additional slits similar to the slits associated wit the second fold line, adjacent interior reinforcing sections being connected to each other by fifth fold liens so as to provide support edges for a plurality of rows of cans.

10. The clip-type carrier of claim 9, including stress relief score lines in the interior reinforcing sections extending form the additional slits to the fifth fold line.

11. A substantially rectangular blank for forming a carrier for supporting a plurality of articles each of which has an upper surface and an outwardly projecting lip adjacent the upper surface, comprising:

an inner top panel flap at one end of the blank and an outer top panel flap at the opposite end of the blank;

side panel sections connected to the inner and outer top panel flaps by first fold lines;

a bottom panel section located substantially centrally of the blank and being connected to side reinforcing sections by second fold liens interrupted by slits;

the side reinforcing sections being connected to the side panel sections by third fold lines;

the slits interrupting the second fold lines being spaced from each other and fro the second fold lines, the slits being dimensioned with respect to an article to be supported by the carrier formed from the blank so as to enable the projecting lip of the article to extend through the spaced slits;

each slit forming an adjacent support edge in the adjacent side reinforcing section, the support edges being adapted to contact the underside of the lip of the article to thereby support the article;

stress relief score lines in the side reinforcing sections extending from the slits to the third fold lines;

means for adhering the top panel flaps to the bottom panel section; and cutouts in the side panel sections for receiving the lip of the article;

the angle between a side reinforcing section and the adjacent side panel section being a relatively small acute angle and the angle between the top panel and the side panel being a relatively large obtuse angle.

12. The carrier of claim 11, wherein the top panel flaps are of a width to overlap each other in the carrier formed from the blank, the inner top panel flap being adapted to be adhered to the bottom panel section and the outer top panel flap being adapted to be adhered to the inner top panel flap.

13. The carrier of claim 11, wherein the inner and outer top panel flaps contain finger holes adapted to be aligned in the overlapped portion of the inner and outer top panel flaps of a carrier formed from the blank to facilitate lifting the carrier.

14. The carrier of claim 11, wherein the bottom panel section includes interior reinforcing sections connected to the bottom panel section by fourth fold lines interrupted by additional slits similar to the slits associated with the second fold line, adjacent interior reinforcing sections being connected to each other by fifth fold lines so as to provide support edges for a plurality of rows of articles.

15. The carrier of claim 14, including stress relief score lines in the interior reinforcing sections extending form the additional slits to the fifth fold line.

* * * * *